US006430365B1

(12) United States Patent
Shimizu

(10) Patent No.: US 6,430,365 B1
(45) Date of Patent: Aug. 6, 2002

(54) HAIR PROCESSING ACCELERATOR WITH ROTATABLE ADJUSTABLE SEMICIRCULAR HEATERS

(75) Inventor: Hirohisa Shimizu, Osaka (JP)

(73) Assignee: Oohiro Works, Ltd. (JP)

( * ) Notice: Subject to any disclaimer, the term of this patent is extended or adjusted under 35 U.S.C. 154(b) by 0 days.

(21) Appl. No.: 09/961,853

(22) Filed: Sep. 24, 2001

(30) Foreign Application Priority Data

Oct. 20, 2000 (JP) ..... 2000-321416

(51) Int. Cl.[7] ..... A45D 20/00

(52) U.S. Cl. ..... 392/413; 392/414; 34/266; 34/96

(58) Field of Search ..... 392/412–415, 392/431; 34/266, 96, 97; 607/96, 100, 109–110, 88, 90–91; 362/238–239, 250, 427–428, 11, 216; D28/16–18, 14; D26/102, 69–70, 80, 61

(56) References Cited

U.S. PATENT DOCUMENTS

| | | | | | |
|---|---|---|---|---|---|
| 1,667,775 | A | * | 5/1928 | Edmands | 392/413 |
| 1,672,597 | A | * | 6/1928 | Bhosys | 362/238 |
| 1,702,028 | A | * | 2/1929 | Blanchard | 392/412 |
| 4,528,618 | A | * | 7/1985 | Bitsch | 362/33 |
| 4,541,442 | A | * | 9/1985 | Hollmann et al. | 392/413 |
| 4,691,451 | A | * | 9/1987 | Giorgis | 34/68 |
| 4,910,382 | A | * | 3/1990 | Kakuya et al. | 392/423 |
| 4,914,273 | A | * | 4/1990 | Matsui | 34/97 |
| D321,411 | S | * | 11/1991 | Moll | D28/17 |
| 5,063,688 | A | * | 11/1991 | Moll et al. | 34/97 |
| 5,231,770 | A | * | 8/1993 | Fertig | 34/266 |
| D357,993 | S | * | 5/1995 | Yuen | D26/65 |

FOREIGN PATENT DOCUMENTS

| | | |
|---|---|---|
| EP | 93824 | * 11/1983 |
| JP | 62-129009 | 6/1987 |
| JP | 1-136603 | 5/1989 |
| JP | 4-644 | 1/1992 |
| JP | 7-32729 | 4/1995 |
| JP | 10-113218 | * 5/1998 |

* cited by examiner

*Primary Examiner*—John A. Jeffery
(74) *Attorney, Agent, or Firm*—Wall Marjama & Bilinski LLP

(57) ABSTRACT

A hair processing accelerator having a first heater unit with a semicircular shape for irradiating hair upon the top of a person's head and second and third heater units each having a semicircular shape for irradiating a hairline on the person's head. The top portion of the second and third units being connected to the first unit by a body supporting part having rotating shafts so that the second and third heater units can rotate within a given range. The hair processing accelerator is mounted in a mobile floor stand.

5 Claims, 6 Drawing Sheets

20
Y0
Y1
y1
y2
1
2
6
7
lock position
unlock position

HAIR PROCESSING ACCELERATOR WITH ROTATABLE ADJUSTABLE SEMICIRCULAR HEATERS

FIELD OF THE INVENTION

The present invention relates to a hair processing accelerator which irradiates heat to a head of hair, thereby to accelerate the processings of hair perm, hair dyeing, hair drying, and the like, when the processings are performed at a barbershop or a beauty salon.

BACKGROUND OF THE INVENTION

Conventionally, when the hair processings of hair perm, hair dyeing, and hair drying are performed at a barbershop or a beauty salon, heat is irradiated to a head of hair by a heater or the like, to accelerate the processings. As a device for irradiating heat to a head of hair, there are a hair processing accelerator described in Japanese Published Patent Application (Examined) No. Hei. 4-644, in which a ring-shaped heater irradiates heat with rotating around a head part, to warm a head of hair, and a hair processing accelerator described in Japanese Published Patent Application (Examined) No. Hei. 7-32729, in which plural separated heaters for irradiating heat to respective parts of both sides, a rear part, and a top portion of a head part, to warm a head of hair.

However, when the processings of hair perm or hair dyeing are performed to a head of hair, heat needs to be irradiated to a hairline in order to accelerate the processings. In this point, according to the conventional hair processing accelerator described in Japanese Published Patent Application (Examined) No. Hei. 4-644, in which a ring-shaped heater performs an eccentric rotational movement at a shaft as its center, to warm a head of hair with rotating around a head part, heat is not uniformly irradiated to a hairline around the head of hair. Further, also according to the hair processing accelerator described in Japanese Published Patent Application (Examined) No. Hei. 7-32729, the heaters positioned at both sides and a rear part of the head part are not enough to uniformly irradiate heat to a hairline around a head of hair, similarly as in the above. Further, according to the hair processing accelerator described in Japanese Published Patent Application (Examined) No. Hei. 7-32729, plural heaters are arranged as if they surround a head of hair, which results in a wide placing area. Therefore, there arises a problem of no room for the storage at a small barbershop or beauty salon.

SUMMARY OF THE INVENTION

The present invention is made to solve the above-mentioned problems, and it is an object of the present invention to provide a hair processing accelerator which can uniformly irradiate heat to a hairline of all circumferences of a head of hair, and the placement area of which can be diminished at the placement.

According to a first aspect of the present invention, a hair processing accelerator comprises, a first heater unit for a head top, which is fixed to a body, having a first heater 1 for a head top of an approximate semicircular shape for irradiating heat to a head top of a head of hair, and second and third heater units for a hairline having a second and a third heaters for a hairline of an approximate semicircular shape, which are fixed rotatably to respective top portions of the first heater unit, for irradiating heat to a hairline part of both sides of the head of hair.

Therefore, it is possible to irradiate heat to a hairline of all circumferences of the head of hair of a person to be washed.

According to a second aspect of the present invention, the hair processing accelerator described in the first aspect, wherein the hair processing accelerator is inserted to a top portion of a stand via a supporting rod connected to the hair processing accelerator, to be movable on a floor face with the stand.

Therefore, it is possible to place the present hair processing accelerator at any place.

According to a third aspect of the present invention, the hair processing accelerator described in the second aspect, wherein the accelerator body for hair processings can be tilted backward and forward to the supporting rod at a supporting shaft as its center, and rotation of the supporting shaft is locked, thereby to fix the tilted position of the accelerator.

Therefore, it is possible to move the hair processing accelerator backward and forward according to a head position of the person to be washed, thereby to sufficiently irradiate heat to a head top portion of the head of hair of the person to be washed.

According to a fourth aspect of the present invention, the hair processing accelerator described in first to third aspects, wherein each of the second and the third heater unit for a hairline can rotate within a range from a state, in which each of the second and the third heater units for a hairline forms an angle 45° with the first heater unit for a head top, to a state, in which the second and the third heater units for a hairline are located in the same plane, and the second and the third heater units for a hairline form an approximate circular shape, and can irradiate heat to each side of the head of hair at a desired position within a the rotatable range.

Therefore, it is possible to control each position of both of the heaters for a hairline according to a position of a head of the person to be washed, to uniformly irradiate heat to a hairline of the head of hair of the person to be washed.

According to the accelerator according to a fifth aspect of the present invention, the hair processing accelerator described in the fourth aspect, wherein the second and the third heater units for a hairline are rotated from a state, in which the second and the third heater units for a hairline are located in a face which forms an angle of about 45° with the first heater unit for a head top, to a state, in which the second and the third heater units are located in a plane which is in parallel to the first heater unit for a head top as well as in parallel to each other, to be in a storage state.

Therefore, it is possible to diminish the placing area of the hair processing accelerator, thereby to avoid occupying much space at the placement.

DETAILED DESCRIPTION OF THE PREFERRED EMBODIMENTS

Embodiment 1

Hereinafter, a hair processing accelerator according to a first embodiment will be described with referring to FIGS. 1 to 7.

Figure 1:
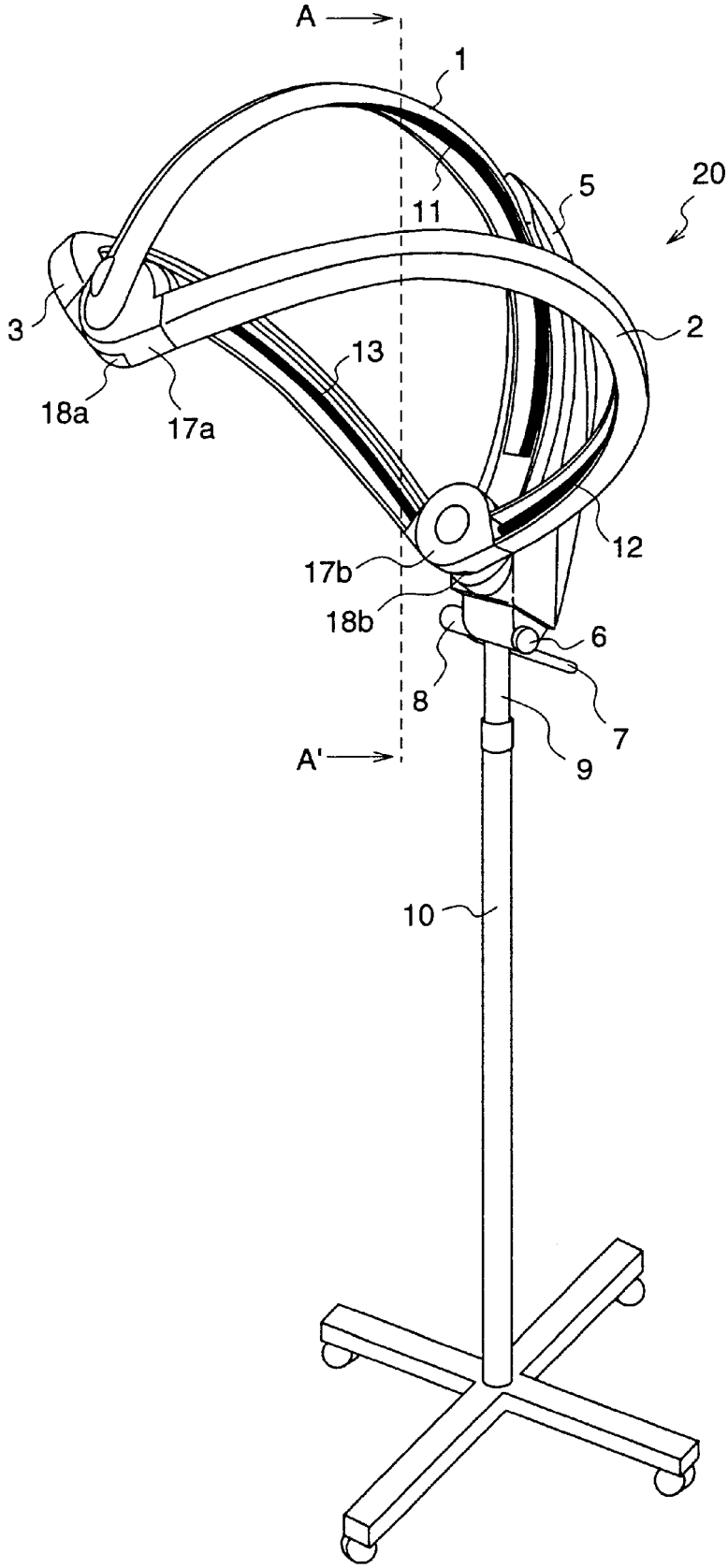
FIG. 1 is a front perspective view illustrating a hair processing accelerator at the timing of the usage state according to a first embodiment of the present invention.
Figure 2:
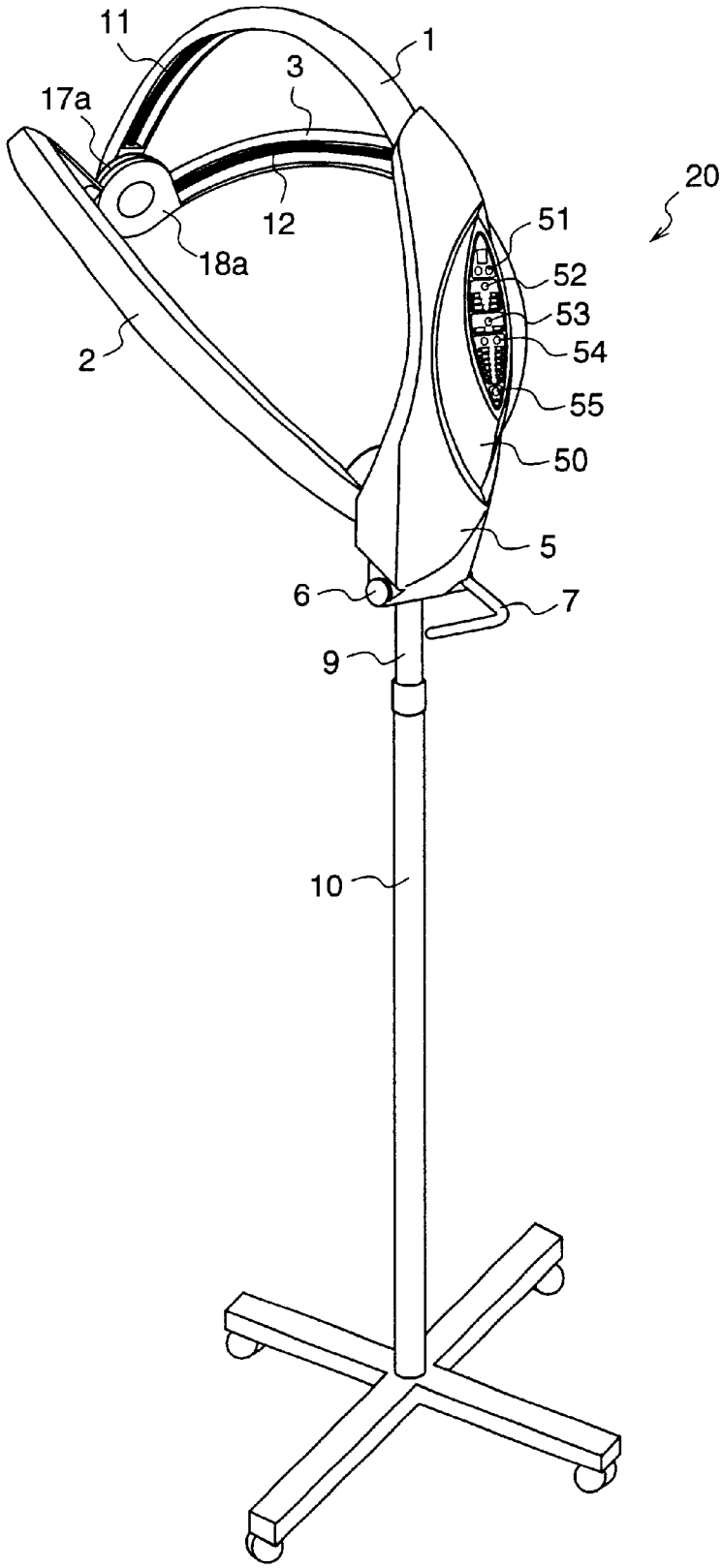
FIG. 2 is a rear perspective view illustrating a hair processing accelerator at the timing of the usage state according to a first embodiment of the present invention.
Figure 3:
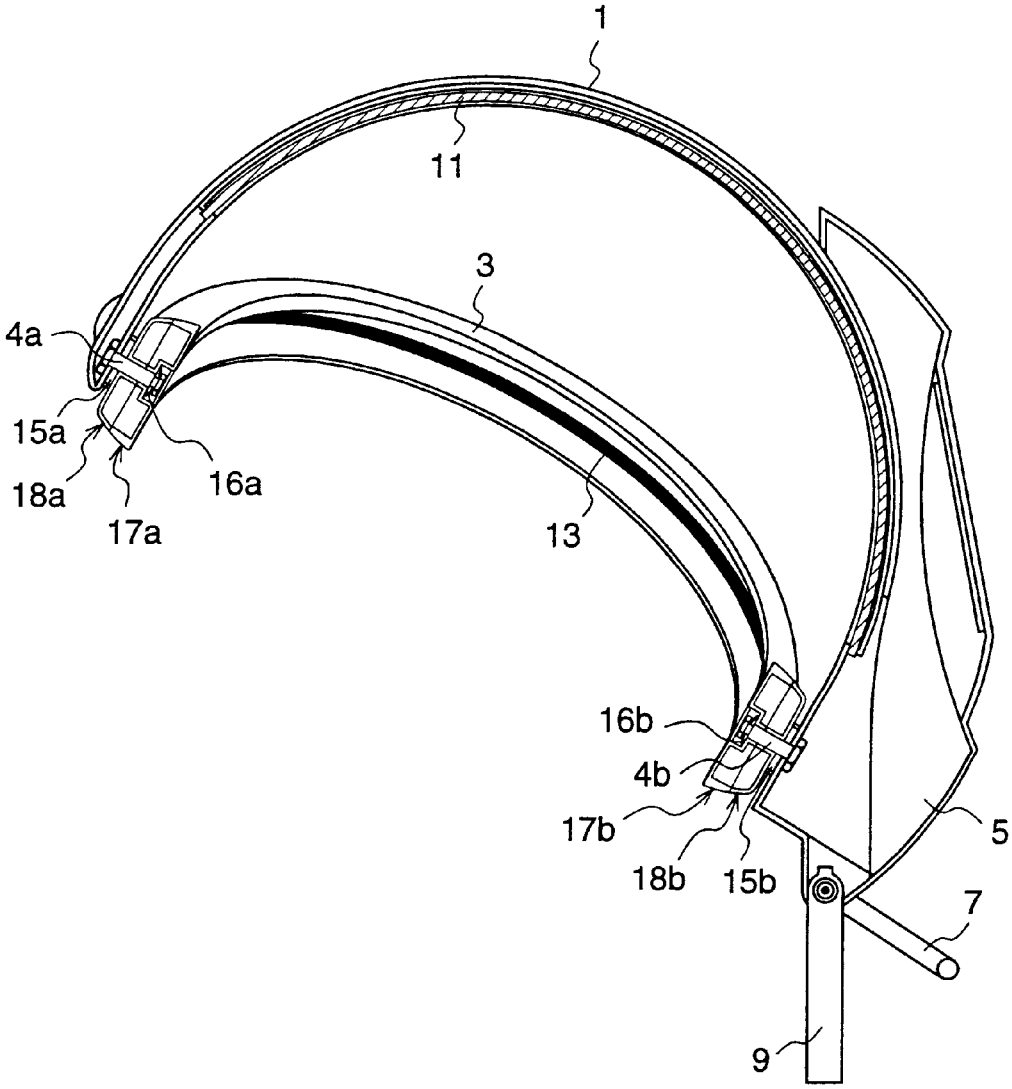
FIG. 3 is a cross sectional view illustrating a hair processing accelerator at the timing of the usage state according to a first embodiment of the present invention.

Initially, a structure of the hair processing accelerator according to the first embodiment will be described with referring to FIGS. 1 to 3. FIG. 1 is a front perspective view illustrating a hair processing accelerator according to the first embodiment of the present invention, at the timing of the usage state. FIG. 2 is the rear perspective view, and FIG. 3 is the cross sectional view illustrating a hair processing part.

In figures, the hair processing accelerator according to the first embodiment has a hair processing part 20 comprising a second and a third heater units for irradiating heat to a hairline of both of left and right sides of a head of hair, which are connected to both sides of a first heater unit 1 for a head top portion for irradiating heat to a top portion of a head of hair with rotatable to the first heater unit for a head top portion within a predetermined range by rotatable shafts 4*a* and 4*b*. The hair processing part 20 is inserted to a top portion of a stand 10 via a supporting rod 9, to be placed at any place on a floor face.

The hair processing part 20 can be tilted backward and forward to the supporting rod 9 at a supporting shaft 6 as its center. A handle 7 fixed to a supporting shaft lock bracket 8 is lifted up, to lock rotation of the supporting shaft 6, thereby fixing the tilted position of the hair processing part 20.

Figure 4:
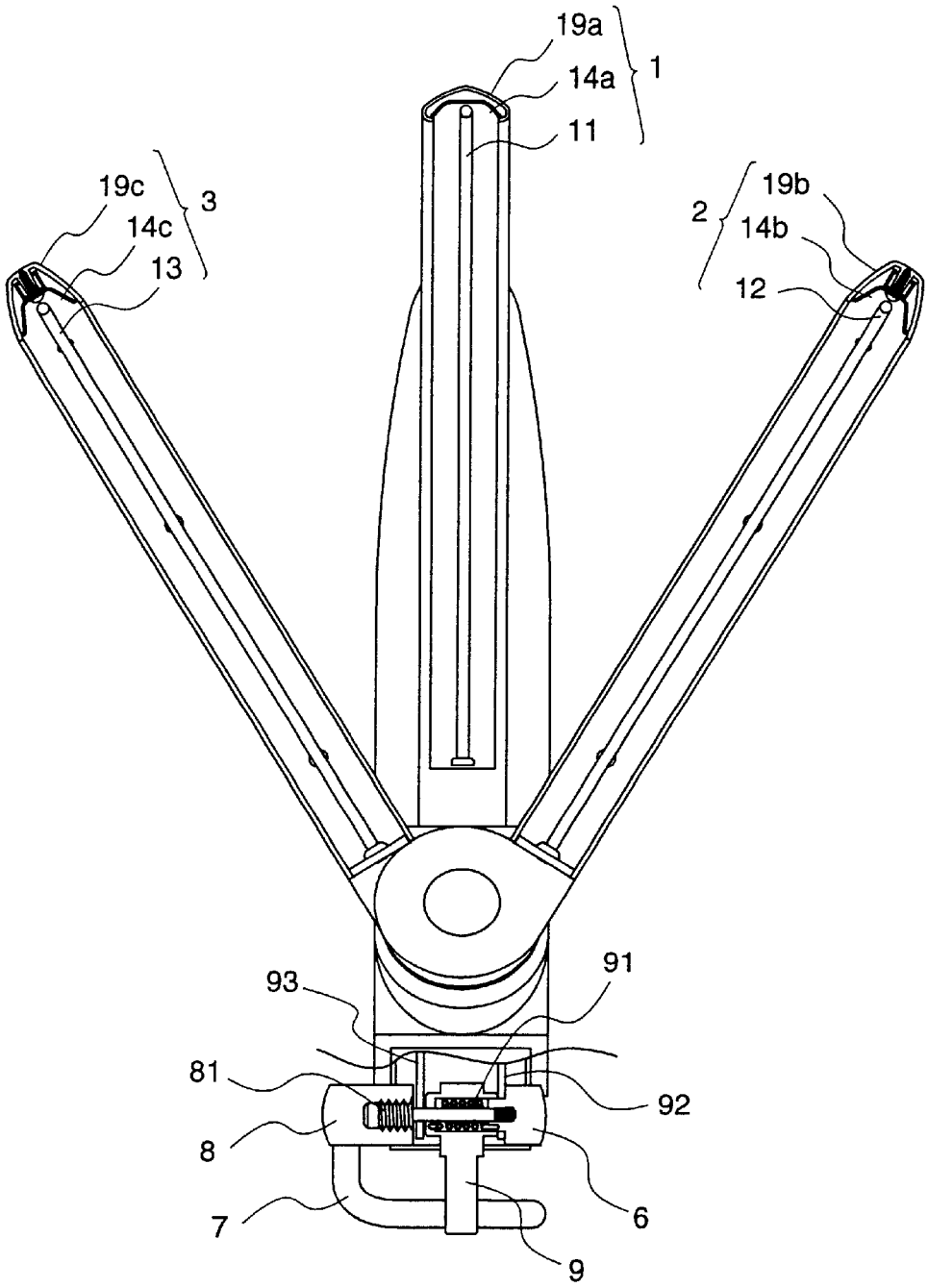
FIG. 4 is a cross sectional view on line A–A' illustrating a hair processing accelerator at the timing of usage state according to a first embodiment of the present invention.
Figure 5:
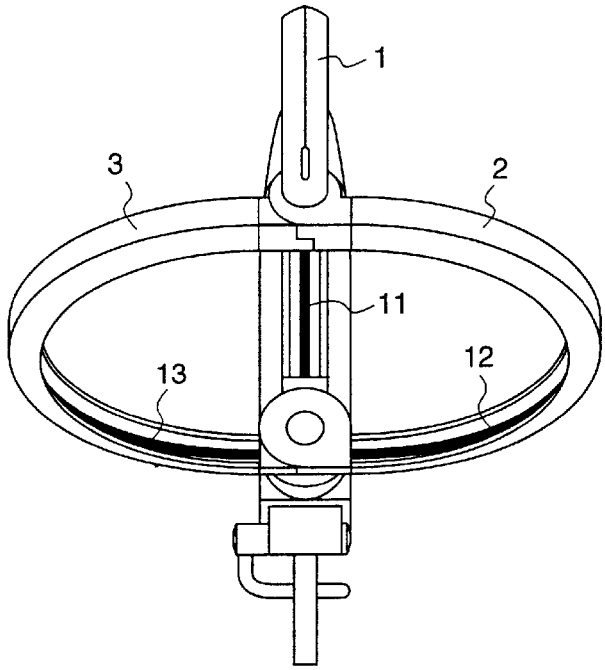
FIG. 5 is an elevation view illustrating a state, in which a second and a third heater units for a hairline of a hair processing accelerator according to a first embodiment of the present invention are rotated, to form an approximate circular shape at the same plane.
Figure 6:
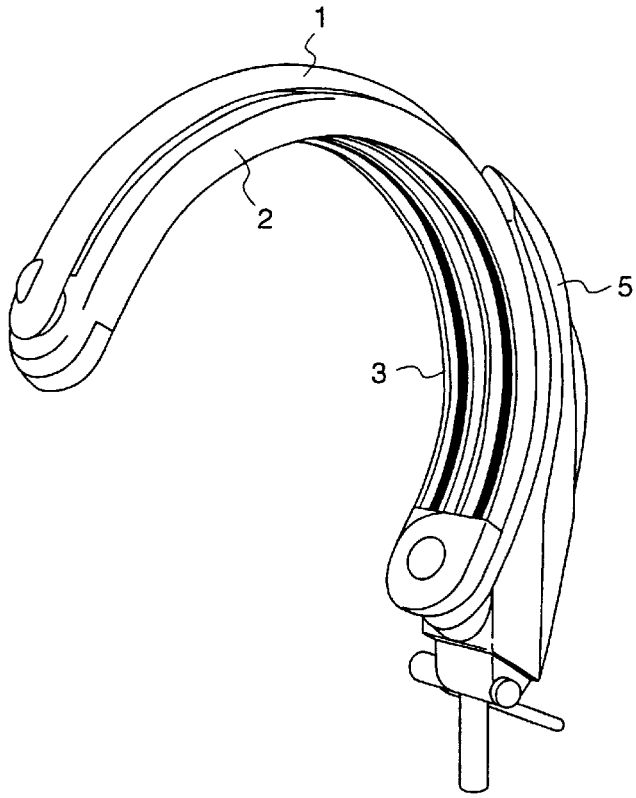
FIG. 6 is a front perspective view illustrating a hairprocessing accelerator according to a first embodiment of the present invention, at the timing of the storage.

Hereinafter, respective parts of the hair processing part 20 will be described in detail with referring to FIGS. 3 to 6. FIG. 4 is a cross sectional view on line A–A' of the hair processing part in FIG. 1. FIG. 5 is an elevation view illustrating a state, in which a second and a third heater units for a hairline of the hair processing accelerator according to the first embodiment are rotated, to form an approximate circular shape. FIG. 6 is a front perspective view illustrating the hair processing accelerator according to the first embodiment, at the timing of the storage state.

In FIG. 4, the respective heater units comprises a heater for irradiating heat to a head of hair, a reflecting plate 14 for enabling to conduct heat of the heater over wider area, and a heater cover 15 to be a frame of the heater and the reflecting plate, the respective heater units which are connected to each other by rotatable shafts 4*a* and 4*b* as shown in FIG. 3.

Initially, connecting portions of the respective heater units will be described. In FIG. 3, reference numerals 17*a* and 17*b* designate a first rotatable bracket provided on both top portions of the second heater unit for a hairline, and reference numerals 18*a* and 18*b* designate a second rotatable bracket provided on both top portions of the third heater unit for a hairline. The first and the second rotatable brackets 17 and 18 are engaged with each other, to connect the heater units 2 and 3 for a hairline. The rotatable shafts 4*a* and 4*b* are provided as a center shaft of the rotatable brackets 17 and 18. Spring-shaped washers 16*a* and 16*b*, which push the first and the second rotatable brackets 17 and 18 to stoppers 15*a* and 15*b*, to fix a position of the first and the second rotatable brackets, are provided to the top portions of the rotatable shafts 4*a* and 4*b*. Both of the heater units 2 and 3 for a hairline are connected rotatably within a predetermined range to the first heater unit 1 for a head top. The heater units 2 and 3 for a hairline can rotate from a state shown in FIGS. 1 and 2, in which the heater units 2 and 3 for a hairline are located within an face which forms an angle of about 45° with the heater unit 1 for a head top, to a state shown in FIG. 5, in which both of the heater units 2 and 3 for a hairline are located in the same plane, to form an approximate circular shape. Both of the heater units 2 and 3 for a hairline irradiate heat to a head of hair from a desired position within the above rotatable range. Further, the heater unites 2 and 3 for a hairline are made to rotate from a state shown in FIG. 5, in which both of the heater units 2 and 3 for a hairline are located in the same plane, to form an approximate circular shape, to a state shown in FIG. 6, in which both of the heater units 2 and 3 for a hairline are located in a plane which is in parallel to the first heater unit 1 for a head top as well as in parallel to each other, thereby making the present hair processing accelerator in a storage state.

Next, a connecting portion of the hair processing part 20 and the supporting rod 9 will be described. In FIG. 4, a chassis 92 at a supporting shaft side among chassises 92 and 93 of the present hair processing part 20 and a supporting shaft lock bolt 81 are fixed to a supporting shaft 6. A handle 7 is fixed to a supporting shaft lock bracket 8, with which the supporting shaft lock bolt 81 is engaged at an approximate rigidity. A supporting rod 9 is provided with a spring 91 therein, one end of the spring 91 which is fixed to the supporting rod 9, and the other end of which is fixed to the supporting shaft 6. This spring 91 pushes outside the supporting shaft 6, to which the chassis 92 is fixed, by resiliency of the spring, thereby to pull near the supporting rod lock bolt 81 fixed to the supporting shaft 6 toward the chassis 93. Therefore, the chassises 92 and 93 of the hair processing part 20 are pressed to the supporting rod 9, thereby to prevent the hair processing part 20 from falling forward. Further, after the hair processing part 20 is tilted backward and forward to the supporting shaft 6, and when the hair processing part 20 is locked at the position so that it cannot move, the handle 7 is lifted up, whereby the supporting shaft lock bracket 8 is more tightly engaged with the supporting shaft lock bolt 81. Therefore, the supporting shaft lock bracket 8 and the supporting shaft 6, respectively, are engaged to the side of the chassises 92 and 93, thereby to lock the position of the hair processing part 20 by the frictional force.

Further, an operation panel 50 of the hair processing accelerator shown in FIG. 2 is attached to a body supporting part 5. The respective switches on the operation panel 50 will be described. Reference numeral 51 designates a timer setting switch for setting a period of irradiating heat. Reference numeral 52 designates a mode setting switch for selecting a processing menu which a person to be washed will receive. Reference numeral 53 designates a start/stop switch for starting or stopping irradiating heat. Reference numeral 54 designates a temperature setting switch for setting temperature of a heater. Reference numeral 55 designates a power on/off switch for switching on a power of the hair processing accelerator.

Figures 7A, 7B, 7C:
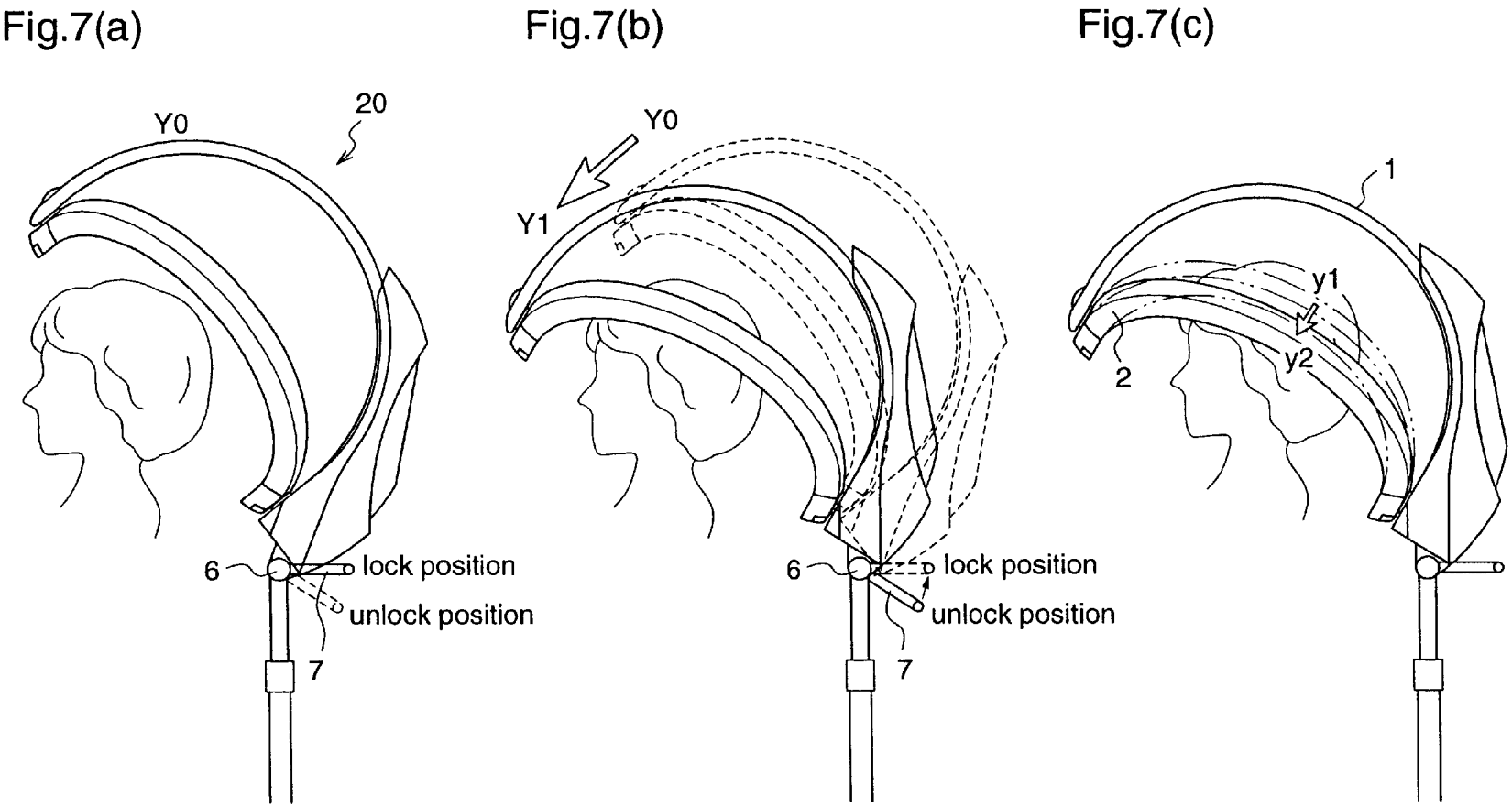
FIG. 7 is a side view illustrating a heater unit of a hair processing accelerator according to a first embodiment of the present invention, at the timing of the position control.

Next, operations will be described with referring to FIG. 7, at the timing of irradiating heat to a head of hair of the person to be washed with employing the hair processing accelerator according to the first embodiment, which is constructed as above. FIG. 7(*a*) is a side view illustrating the respective heater units of the hair processing part 20 of the hair processing accelerator according to the first embodiment, before each position is not adjusted. FIG. 7(*b*) is a side view illustrating the hair processing part 20 of the hair processing accelerator of the first embodiment, at the timing when the position is adjusted. FIG. 7(*c*) is a side view illustrating the heater units 2 and 3 for a hairline of the accelerator according to the first embodiment, at the timing when the position is adjusted.

Initially, a hair dresser (not shown) places the hair processing accelerator behind a person to be washed who is seated on a barber or a beauty chair (not shown) with the hair processing part 20 being positioned at an up position keeping position Y0 shown in FIG. 7(*a*).

Then, the hair dresser tilts the hair processing part 20 positioned at the up position keeping position Y0 in FIG. 7(*a*) to a desired position Y1 shown by a solid line in FIG. 7(*b*).

Here, the tilting movements will be concretely described. When the hair processing part 20 is moved from the position Y0 in FIG. 7(*a*) to the position Y1 shown by a solid line in FIG. 7(*b*), initially, the hair dresser lowers down the handle 7 from a lock position to an unlock position in FIG. 7(*a*), thereby to open the lock of the hair processing part 20. Next, the hair dresser tilts the hair processing part 20 forward to the position Y1 shown by the solid line in FIG. 7(*b*), the position of which is adjusted to a head part of the person to be washed, until the hair processing part 20 reaches the position Y1 shown by the solid line. Then, the hair dresser lifts the handle 7 to the lock position, to lock the tilted position of the hair processing part 20.

As described above, after a position of the hair processing part 20 is fixed, then the hair dresser rotates both of the heater units 2 and 3 for a hairline at the rotating shaft 4 as its center so as to locate the heater units 2 and 3 for a hairline, which are located at y1 shown by a dotted line in FIG. 7(*c*), at a position y2 shown by a solid line.

The rotational movement will be concretely described. When the heater units 2 and 3 for a hairline are moved from the position y1 shown by a dotted line to y2 shown by a solid line in FIG. 7(*c*), the hair dresser first rotates with lifting up by his hands the second and third heater units 2 and 3 for a hairline, which are settled at the position y1 shown by the dotted line in FIG. 7(*c*) by a washer 16. Then, when those are moved to the position y2 shown by the solid line in FIG. 7(*c*), the hair dresser looses his hold, thereby settling both of the heater units 2 and 3 for a hairline at the position, y2.

As described above, after the respective positions of the hair processing part 20 and both of the heater units 2 and 3 for a hairline are adjusted, the hair dresser turns on electricity of the hair processing accelerator, and pushes the power on/off switch 55 on the operation panel 50, to turn the power on the hair processing accelerator, and then selects a processing menu among hair perm, hair dyeing, and a hair treatment, which the person to be washed will receive, by the mode setting switch 52. According to the mode setting switch 52, for example, when the processing menu of hair perm is selected by the mode setting switch 52, an approximate temperature of the heater and a heat irradiating period which are suitable for accelerating the hair perm processing can be automatically set.

Then, after the setting of temperature of the heater and the heat irradiating period are completed, the hair dresser pushes the start/stop switch 53, to start irradiating heat to the head of hair of the person to be washed.

After heat is started to be irradiated to the head of hair of the person to be washed by the heater of the hair processing accelerator, when the person to be washed claims against the hair dresser that he cannot stand the heat, the hair dresser pushes a temperature setting switch 54, to lower the temperature of the heater to the desired temperature of the person to be washed. When the heat irradiating period is required to be extended due to the lowered temperature of the heater, the hair dresser pushes the timer setting switch 51, to extend the period. As described above, a temperature and a period other than the temperature and the irradiating period set by the mode setting switch 52 can be set, when the hair dresser pushes the temperature setting switch 54 and the timer setting switch 51.

After the set time is passed, the heater of the hair processing accelerator is automatically turned out, and the heat irradiation to the head of hair of the person to be washed is completed. And then, the hair dresser pushes the power on/off switch 55, to turn out the hair processing accelerator. After, the hair processing part 20 is rotated to the up position keeping position Y0 again, the hair processing accelerator is moved from the behind of the person to be washed to another place, wherein the hair processings are not obstructed.

Further, when a barbershop or a beauty salon is closed, and the hair processing accelerator should be stored, the second and the third heater units 2 and 3 for a hairline are moved from the position y2 shown by the solid line in FIG. 7(*c*) to a state, in which the respective heater units are located in a face in parallel to a face at which the first heater unit 1 for a head top is located, thereby to make the hair processing accelerator in a storage state with the diminished placement area.

As described above, the hair processing accelerator according to the first embodiment is provided with the second and the third heater units 2 and 3 for a hairline for irradiating heat to both sides of the head of hair at the both sides of the first heater unit 1 for a head top for irradiating heat to the head top of the person to be washed, wherein both of the heater units 2 and 3 for a hairline of a head of hair are made to be rotatable within the predetermined range, and further the hair processing part 20 is made to be also rotatable backward and forward at the supporting shaft 6. Therefore, the hair dresser can adjust positions of the respective heaters 11, 12, and 13 according to a head position of the person to be washed. Further, when the hair perm and the hair dyeing are performed to the head of hair of the person to be washed, it is possible to uniformly irradiate heat to a hairline of all circumferences of the head of hair.

Further, according to the hair processing accelerator according to the first embodiment, the hair processing part 20 is inserted to the top portion of the stand 10, thereby to place at any places.

Further, according to the hair processing accelerator of the first embodiment, after the hair processings are completed, the second and the third heater units 2 and 3 for hairline are rotated at the rotatable shafts 4*a* and 4*b* as its center, to be made in a storage state, in which those are positioned at a plane which is in parallel to a plane at which the first heater unit 1 is located as well as in parallel to each other. Therefore, the placement area of the hair processing accelerator can be diminished, and the accelerator can be placed even at a small barbershop or beauty salon.

What is claimed is:

1. A hair processing accelerator comprises, a first heater unit for a head top, which is fixed to a body, having a first heater 1 for a head top of an approximate semicircular shape, for irradiating heat to a head top of a head of hair, and second and third heater units for a hairline having second and third heaters for a hairline of an approximate semicircular shape, which are fixed rotatably to respective top portions of the first heater unit, for irradiating heat to a hairline part of both sides of the head of hair.

2. The hair processing accelerator described in claim 1, wherein the hair processing accelerator body is inserted to a top portion of a stand via a supporting rod connected to the hair processing accelerator body, to be movable on a floor face with the stand.

3. The hair processing accelerator described in claim 2, wherein the hair processing accelerator body can be tilted backward and forward to the supporting rod at a supporting shaft as its center, and rotation of the supporting shaft is locked, thereby to fix the tilted position of the hair processing accelerator body.

4. The hair processing accelerator described in claim 1, wherein each of the second and the third heater units for a hairline can rotate within a range from a state, in which each of the second and the third heater units for a hairline forms a 45° angle with the first heater unit for a head top to a state in which the second and the third heater units for a hairline are located in the same plane, and the second and the third heater units for a hairline form an approximate circular shape, and can irradiate heat to each side of the head of hair at a desired position within a rotatable range.

5. The hair processing accelerator described in claim 4, wherein the second and the third heater units for a hairline are rotated from a state, in which the second and the third heater units for a hairline are located in a top, to a state, in which the second and the third heater units are located in a plane which is in parallel to the first heater unit for a head top as well as in parallel to each other, to be in a storage state.

* * * * *